US006698858B1

(12) United States Patent
Askeland et al.

(10) Patent No.: US 6,698,858 B1
(45) Date of Patent: Mar. 2, 2004

(54) SYSTEM AND METHOD FOR DECREASING PRINT BANDING WITH TIME DELAY SYNCHRONIZATION OF EJECTED INK

(75) Inventors: Ronald A. Askeland, San Diego, CA (US); James A. Feinn, San Diego, CA (US); David D. Helfrick, San Diego, CA (US); Jason R. Arbeiter, Poway, CA (US); Jason Quintana, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/448,977

(22) Filed: May 30, 2003

(51) Int. Cl.[7] ..... B41J 29/38; B41J 2/65

(52) U.S. Cl. ..... 347/12; 347/57

(58) Field of Search ..... 347/41, 16, 57, 347/54, 9, 12

(56) References Cited

U.S. PATENT DOCUMENTS 6,578,950 B2 * 6/2003 Matsumoto et al. ..... 347/42
6,598,951 B2 * 7/2003 Ikemoto et al. ..... 347/13

* cited by examiner

*Primary Examiner*—Thinh Nguyen

(57) ABSTRACT

The present invention includes as one embodiment an inkjet printing method for decreasing print banding in a thermal inkjet printhead having a plurality of substrates with adjacent overlapping and non-overlapping regions between the substrates, the method comprising synchronizing a difference in time delay between ink ejected from the adjacent overlapping and non-overlapping regions of each substrate to reduce the difference.

30 Claims, 5 Drawing Sheets

SYSTEM AND METHOD FOR DECREASING PRINT BANDING WITH TIME DELAY SYNCHRONIZATION OF EJECTED INK

BACKGROUND OF THE INVENTION

Multi-substrate modules are commonly used for high-resolution printheads or wide page array printheads and typically include plural substrates with adjacent overlapping and non-overlapping regions defining the area between adjacent substrates. One factor in assuring high print quality of inkjet printers with multi-substrate print modules is the control over the uniformity of ink drops ejected onto the print media.

In current systems, uniform printing is used from all columns of the multi-substrate module. However, this results in a large difference in the time delay for drops printed in the adjacent overlapping region versus the non-overlapping regions. As such, in the adjacent overlapping regions, ink is laid on ink rather than ink onto the print media, due to the adjacent overlapping substrates.

Consequently, ink laid on ink, in relation to drying time and image quality, can cause printed image quality problems due to the difference in the interaction between the ink and the media in the adjacent overlapping regions versus the non-overlapping regions. One of the image quality problems is print banding. Print banding is the appearance of repetitive horizontal bands within a printed image, which may appear as light or dark bands. Print banding is particularly undesirable in printers that require high quality printouts, such as images or photographs, where the effects of banding are more likely to be visible.

SUMMARY OF THE INVENTION

The present invention includes as one embodiment an inkjet printing method for decreasing print banding in a thermal inkjet printhead having a plurality of substrates with adjacent overlapping and non-overlapping regions between the substrates, the method comprising synchronizing a difference in time delay between ink ejected from the adjacent overlapping and non-overlapping regions of each substrate to reduce the difference.

BRIEF DESCRIPTION OF THE DRAWINGS

The present invention can be further understood by reference to the following description and attached drawings that illustrate the preferred embodiments. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention as defined by the claims appended below.

I. General Overview

Figure 1:
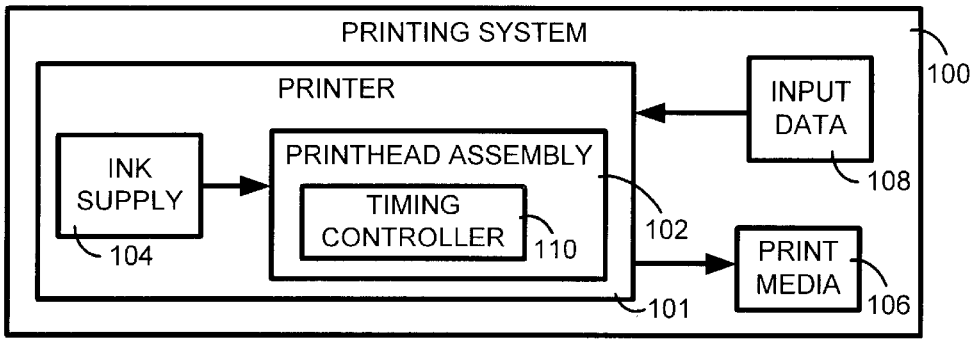
FIG. 1 shows a block diagram of an overall printing system incorporating one embodiment of the present invention.

FIG. 1 shows a block diagram of an overall printing system incorporating one embodiment of the present invention. The printing system 100 of one embodiment of the present invention includes a printhead assembly 102, ink supply or ink reservoir 104 and print media 106. At least one printhead assembly 102 and ink reservoir 104 are typically included in a printer 101. Input data 108 is sent to the printing system 100 and includes, among other things, information about the print job.

In addition, the printhead assembly 102 includes a timing controller 110, which may be implemented as firmware and/or hardware incorporated into the printer in a master controller device (not shown), or physically integrated with the printhead assembly 102 as a printhead controller device. Also, the timing controller 110 can be implemented by a printer driver as software operating on a computer system (not shown) that is connected to the printer 101 or a processor (not shown) that is physically integrated with the printhead assembly 102.

The printhead assembly 102 also includes plural substrates (not shown), such as plural semiconductor wafers or dies. The plural substrates may be in the form of a multi-substrate or multi-die module for a single printhead printer, as multiple single printhead modules for a wide page array printer or combination thereof. Each substrate or die includes ink ejection elements and associated ejection chambers for releasing the ink through corresponding nozzles or orifices in respective adjacent nozzle members. Also, each substrate can have its own controller disposed thereon that is synchronized with the other controllers.

The plural substrates are located adjacent to one another with adjacent overlapping and non-overlapping regions existing between each adjacent substrate (discussed in detail below). The timing controller 110 is operatively connected to the ink ejection elements of each substrate and receives and processes input data 108 to create a consistent time delay difference between ink ejected from the adjacent overlapping and non-overlapping regions of the ink ejection elements of each substrate.

The timing controller 110 decreases print banding by creating a consistent difference in the time delay between ink ejected from the adjacent overlapping and non-overlapping regions of each substrate. For multi-die modules, this is achieved by controlled print distribution. Each die has inner and outer printing areas, such as inner and outer trenches. Inner trenches face opposing inner trenches of multiple dies, while outer trenches are located on opposite sides of the inner trenches of each die (the inner and outer trenches will be discussed in detail below with reference to FIGS. 7A and 7B). In non-overlap region, the ink is evenly printed in each trench of each die (half in the inner trench and the other half in the outer trench of each die to create an even distribution of ink between the trenches in each die). However, in the adjacent overlap region, although the same amount of ink is printed, the inner trenches of each die receive ink but the outer trenches of each die do not receive ink. This reduces artifacts and allows a smoother transition from the non-overlap to the adjacent overlap areas. Consequently, this reduces the difference in the time delay between the adjacent overlapping and non-overlapping regions to produce more consistent ink and print media 108 interactions and to help improve image quality.

II. Exemplary Printing System

Figure 2:
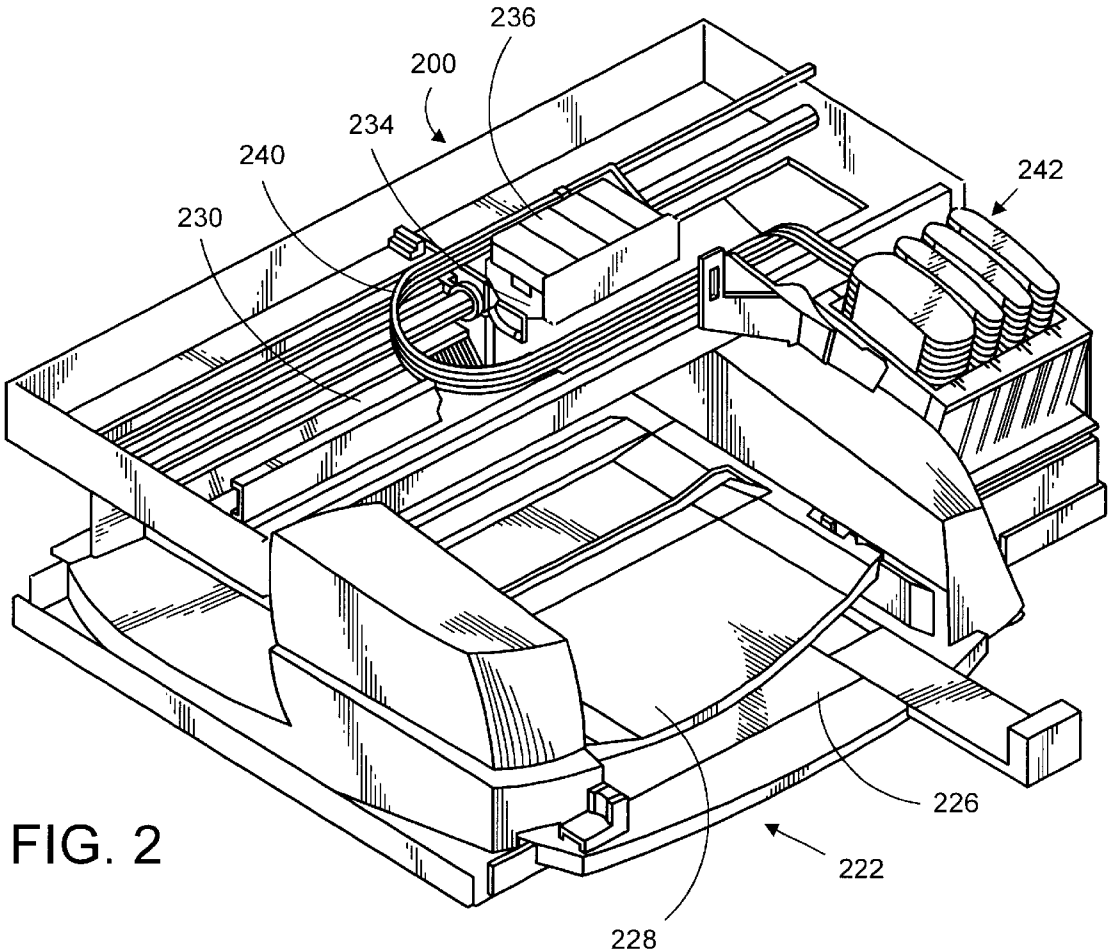
FIG. 2 is an exemplary printer usable with the system of FIG. 1 that incorporates one embodiment of the invention and is shown for illustrative purposes only.

FIG. 2 is an exemplary embodiment of a printer that incorporates a multi-substrate or multi-die module for a single printhead assembly according to an embodiment of the invention and is shown for illustrative purposes only. As discussed above, other printers, such as a wide page array printer with multiple single substrate printhead assemblies can incorporate embodiments of the present invention.

Generally, printer 200, which is shown in FIG. 2 as one type of printer 101 of FIG. 1, can incorporate the printhead assembly 102 of FIG.1 and further include a tray 222 for holding print media. When a printing operation is initiated, print media, such as paper, is fed into printer 200 from tray 222 preferably using sheet feeder 226. The sheet is brought around in a U direction and then travels in an opposite direction toward output tray 228. Other paper paths, such as a straight paper path, can also be used.

The sheet is stopped in a print zone 230, and a scanning carriage 234, supporting one or more printhead assemblies 236, is scanned across the sheet for printing a swath of ink thereon. After a single scan or multiple scans, the sheet is then incrementally shifted using, for example a stepper motor or feed rollers to a next position within the print zone 230. Carriage 234 again scans across the sheet for printing a next swath of ink. The process repeats until the entire sheet has been printed, at which point it is ejected into the output tray 228.

The print assemblies 236 can be removeably mounted or permanently mounted to the scanning carriage 234. Also, the printhead assemblies 236 can have self-contained ink reservoirs which provide the ink supply 104 of FIG. 1. Alternatively, each print cartridge 236 can be fluidically coupled, via a flexible conduit 240, to one of a plurality of fixed or removable ink containers 242 acting as the ink supply 104 of FIG. 1.

Figure 3:
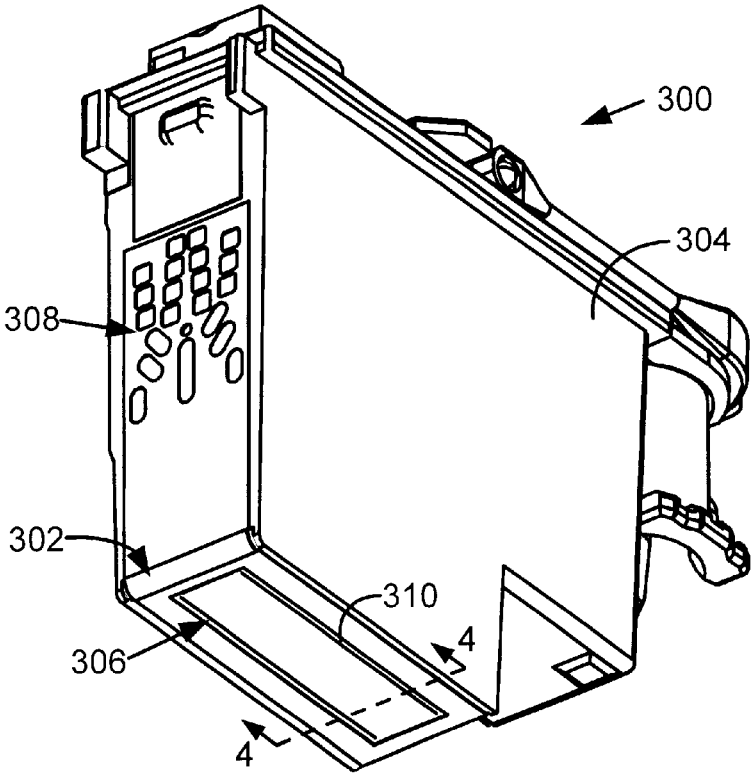
FIG. 3 shows for illustrative purposes only a perspective view of an exemplary print cartridge usable with the printer of FIG. 2 incorporating one embodiment of the printhead assembly of the present invention.

FIG. 3 shows for illustrative purposes only a perspective view of an exemplary print cartridge 300 (an example of the printhead assembly 102 of FIG. 1) that incorporates one embodiment of the invention and is shown for illustrative purposes only. A detailed description of one embodiment of the present invention follows with reference to a typical print cartridge used with a typical printer, such as printer 200 of FIG. 2. However, embodiments of the present invention can be incorporated in any printhead and printer configuration.

Referring to FIGS. 1 and 2 along with FIG. 3, the print cartridge 300 is comprised of a thermal head assembly 302 and a body 304. The thermal head assembly 302 can be a flexible material commonly referred to as a Tape Automated Bonding (TAB) assembly. The thermal head assembly 302 contains a nozzle member 306 to which the plural substrates are attached to form the printhead assembly 102.

Thermal head assembly 302 also has interconnect contact pads (not shown) and is secured to the printhead assembly 300 with suitable adhesives. Contact pads 308 align with and electrically contact electrodes (not shown) on carriage 234. The nozzle member 306 preferably contains plural parallel rows of offset nozzles 310 for each substrate through the thermal head assembly 306 created by, for example, laser ablation. Other nozzle arrangements can be used, such as non-offset parallel rows of nozzles.

III. Component Details

Figure 4:
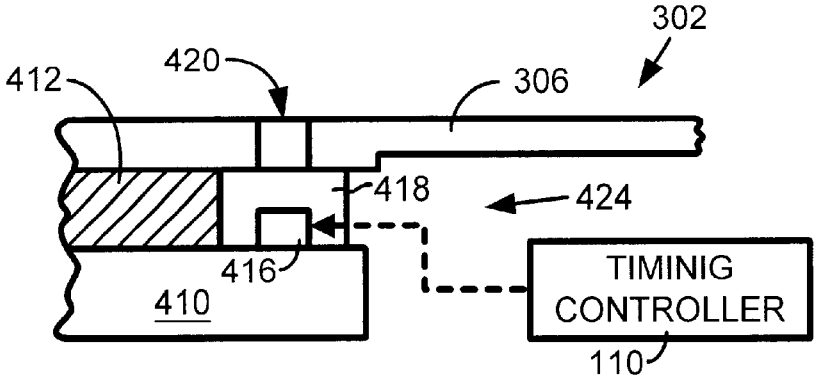
FIG. 4 is a schematic cross-sectional view taken through a portion of section line 4—4 of FIG. 3 showing a portion of the ink chamber arrangement of an exemplary printhead substrate in the print cartridge of FIGS. 1 and 3.

FIG. 4 is a cross-sectional schematic taken through a portion of section line 4—4 of FIG. 3 of the print cartridge 300 utilizing one embodiment of the present invention. A detailed description of one embodiment of the present invention follows with reference to a typical print cartridge 300. However, embodiments of the present invention can be incorporated in any printhead configuration. Also, the elements of FIG. 4 are not to scale and are exaggerated for simplification.

Figure 7A:
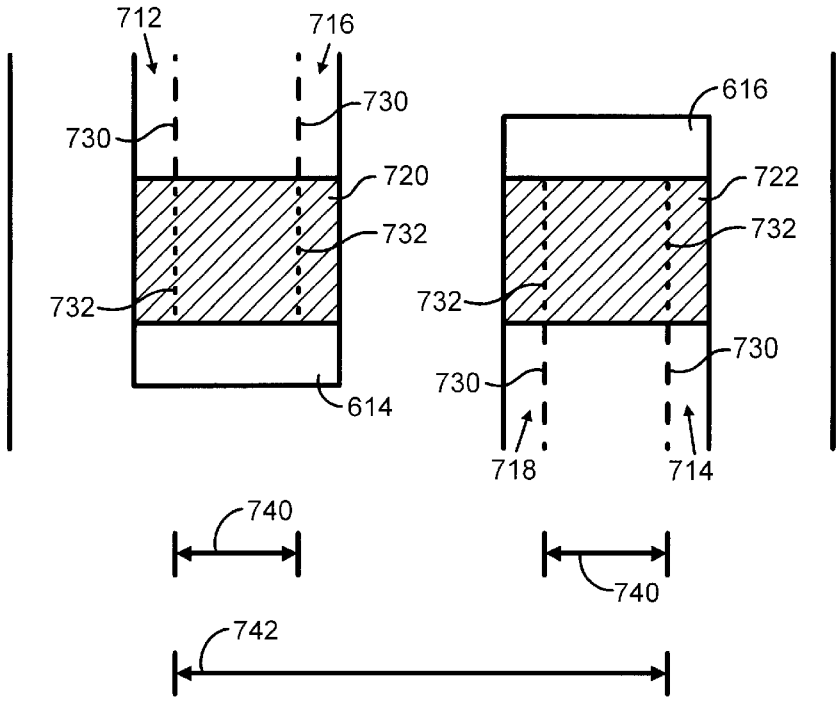
FIGS. 7A–7B illustrate a working example of the operation of embodiments of the present invention.
Figure 7B:
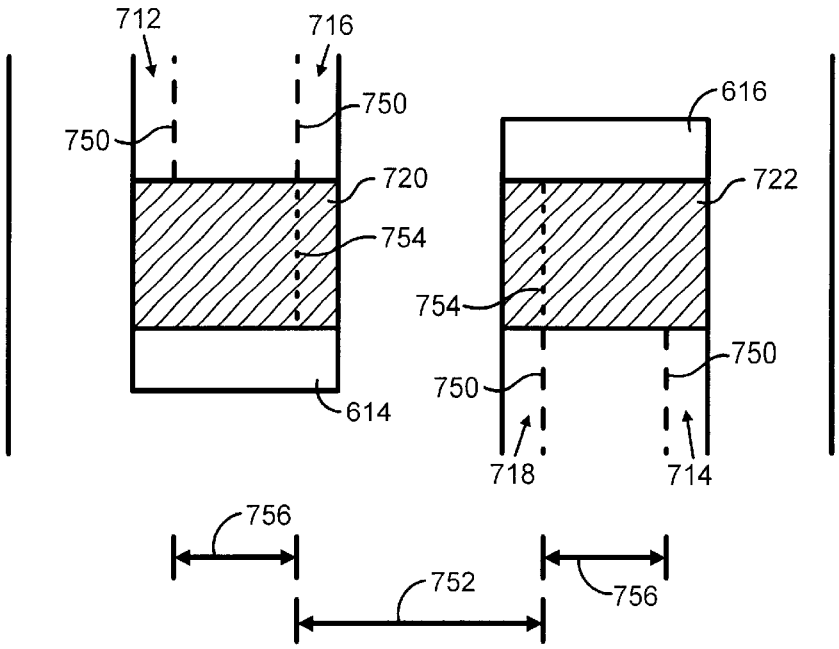

Referring to FIGS. 1–3 along with FIG. 4, in general, the thermal head assembly 302 includes plural substrates 410 (only one substrate is shown in FIG. 4 for simplicity) and a barrier layer 412 located between the nozzle member 306 and each substrate 410 for insulating conductive elements from each substrate 410 and for forming a plurality of ink ejection chambers 418 (one of which is shown in FIG. 4, while both are shown as 614 and 616 in FIGS. 7A and 7B). The plural substrates are located adjacent to one another with adjacent overlapping and non-overlapping regions existing between each substrate.

Also included is a corresponding plurality of ink ejection elements 416 disposed on each substrate 410. The timing controller 110 is operatively connected to the ink ejection elements 416. Each chamber 418 is associated with a different one of the ink ejection elements 416. The timing controller 110 receives print data and processes the print data to create a consistent time delay difference between ink ejected from the adjacent overlapping and non-overlapping regions of the ink ejection elements of each substrate.

An ink ejection or vaporization chamber 418 is adjacent each ink ejection element 416 of each substrate 410, as shown in FIG. 4, so that each ink ejection element 416 is located generally behind a single orifice or nozzle 420 of the nozzle member 306. Thus, each ink ejection element 416 is associated with, and ejects ink from, a corresponding nozzle 420. The nozzles 420 are shown in FIG. 4 to be located near an edge of the substrate 410 for illustrative purposes only. The nozzles 420 can be located in other areas of the nozzle member 306, such as centered between an edge of the substrate 410 and an interior side of the body 304.

The ink ejection elements 416 may be resistor heater elements or piezoelectric elements, but for the purposes of the following description, the ink ejection elements may be referred to as resistor heater elements. In the case of resistor heater elements, each ink ejection element 416 acts as an ohmic heater when selectively energized by one or more pulses applied sequentially or simultaneously to one or more of the contact pads via the integrated circuit. The orifices 420 may be of any size, number, and pattern, and the various figures are designed to simply and clearly show the features of one embodiment of the invention. The relative dimensions of the various features have been greatly adjusted for the sake of clarity.

Figure 5:
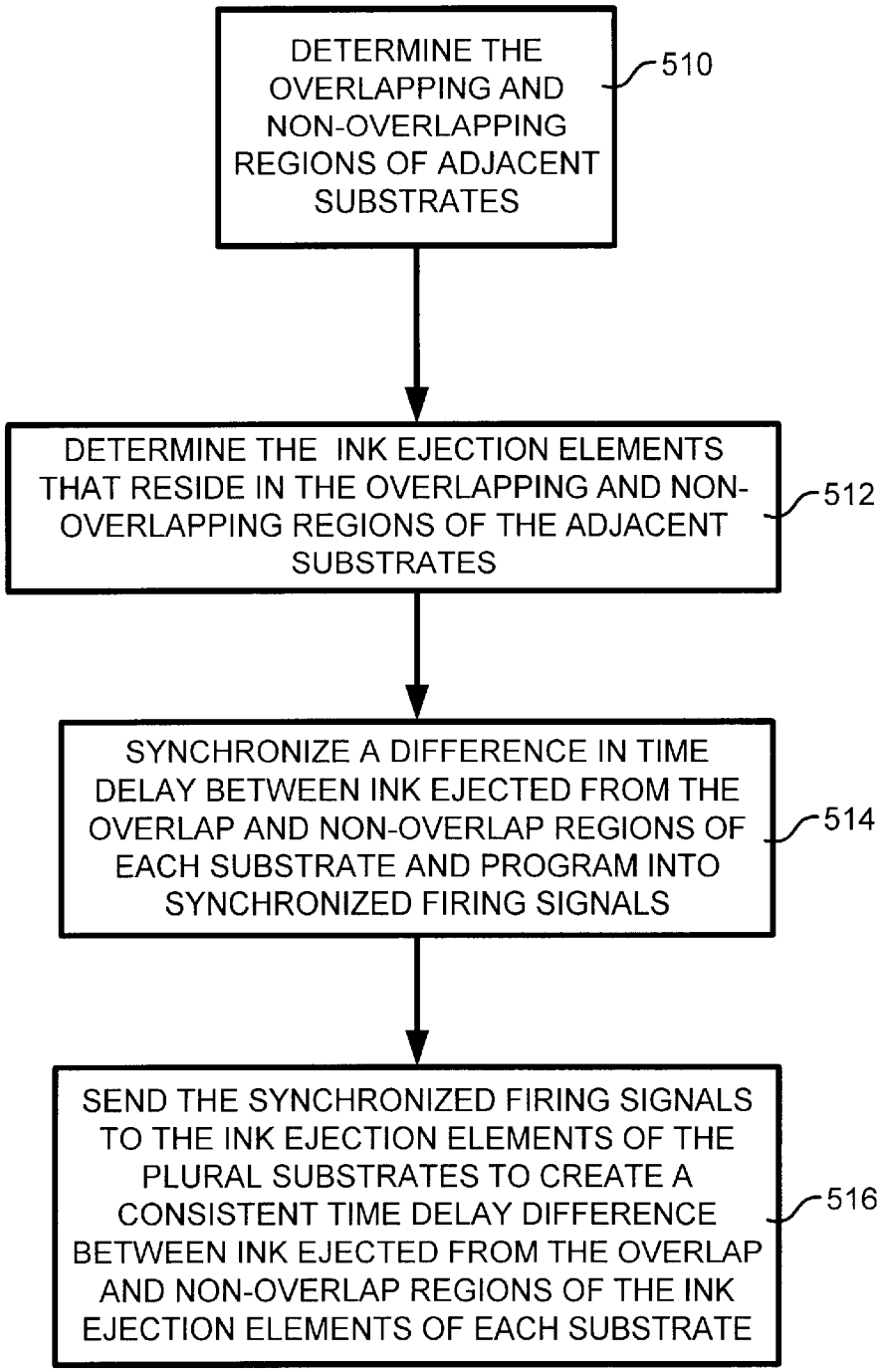
FIG. 5 is a flow diagram of the operation of a printhead assembly according to FIG. 3 that incorporates an embodiment of the present invention.

FIG. 5 is a flow diagram of the operation of a printhead assembly according to FIG. 3 that incorporates an embodiment of the present invention. First, adjacent overlapping and non-overlapping regions of adjacent substrates are determined (step 510). Second, the ink ejection elements that reside in the adjacent overlapping and non-overlapping regions of the adjacent substrates are determined (step 512).

Third, a difference in time delay between ink ejected from the adjacent overlapping and non-overlapping regions of each substrate is synchronized and programmed into synchronized firing signals (step 514) to create a consistent difference in time delay. Last, the synchronized firing signals are sent to the ink ejection elements of the plural substrates to create a consistent time delay difference between ink ejected from the adjacent overlapping and non-overlapping regions of the ink ejection elements of each substrate (step 516).

III. Working Example

Figure 6:
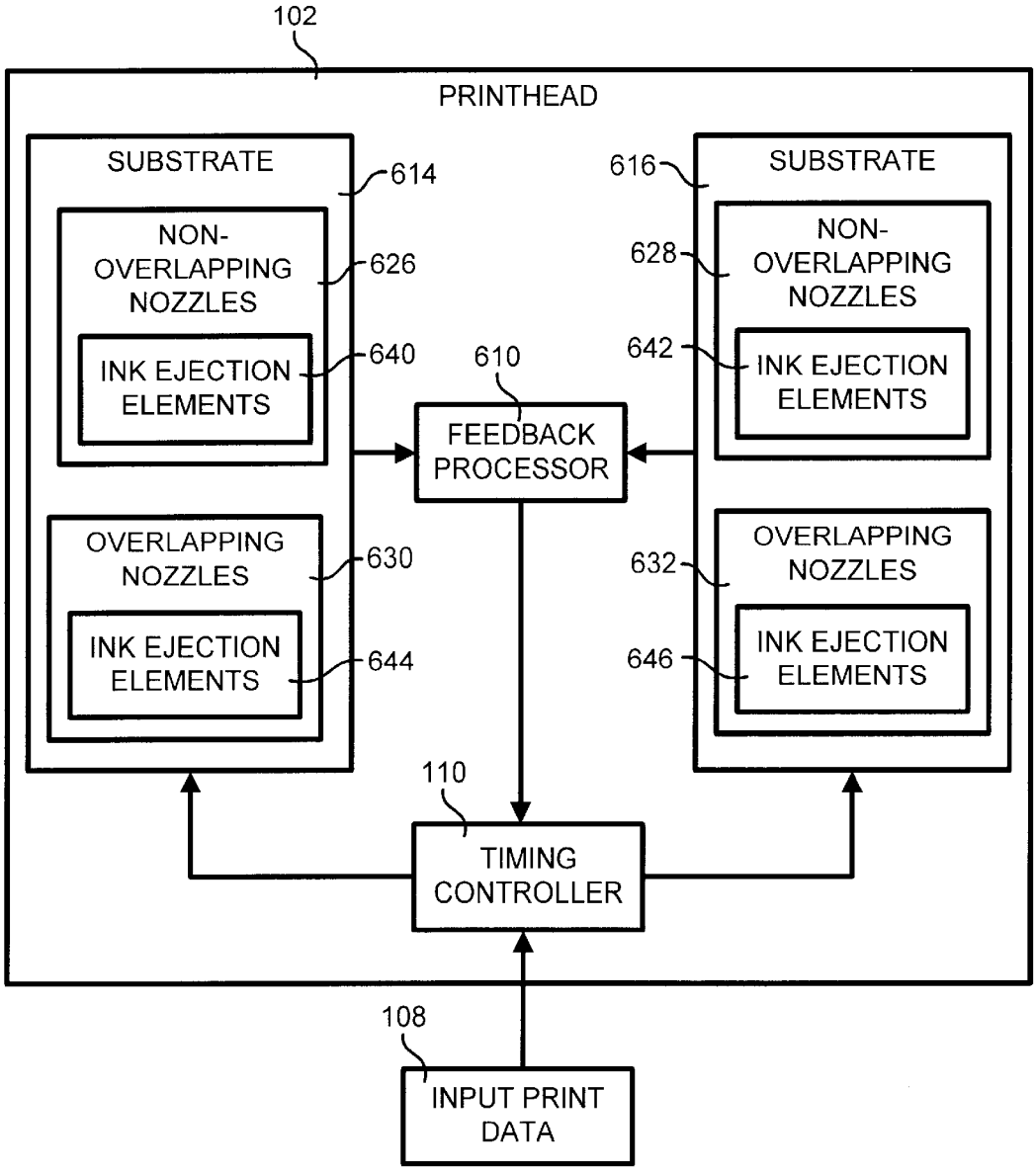
FIG. 6 is a block diagram of a printhead assembly according to FIG. 3 that incorporates an embodiment of the present invention.

FIG. 6 is a block diagram of a printhead assembly according to FIG. 3 that incorporates an embodiment of the present invention. Referring to FIGS. 1–5 along with FIG. 6, the printhead assembly 102 includes a timing controller 110, a feedback processor 610 and plural substrates 614, 616 (only two substrates are shown for illustrative purposes), which can be in the form of a multi-substrate module.

Each substrate 614, 616 respectively includes non-overlapping nozzle arrangements 626, 628 and adjacent overlapping nozzle arrangements 630, 632. The non-overlapping nozzle arrangements 626, 628 include ink ejection elements 640, 642 and the adjacent overlapping nozzle arrangements 630, 632 include ink ejection elements 644, 646. The nozzles of the non-overlapping nozzle arrangement 626 are located in regions that do not overlap with nozzles of the non-overlapping nozzle arrangement 628. The nozzles adjacent to each other of the overlapping nozzle arrangement 630 are located in regions that are adjacent to each other and overlap with nozzles of the overlapping nozzle arrangement 632.

In operation, the feedback processor 610 receives feedback signals from the substrates 614 and 616, such as position and timing signals, and determines the locations of the ink ejection elements and nozzles. In particular, feedback processor 610 determines the non-overlapping regions of the non-overlapping nozzles 626, 628 and the overlapping regions of the overlapping nozzles 630, 632 for electronically mapping the regions and the ink ejection elements associated with these regions.

The feedback processor 610 then sends the map of the regions to the timing controller 110. The timing controller 110 uses the input print data 108 and the map of the regions to formulate a synchronized firing pattern for the ink ejection elements in both regions. The synchronization pattern synchronizes a difference in time delay between ink ejected from the adjacent overlapping and non-overlapping regions of each substrate 614, 616 to create a consistent time delay difference between the regions.

FIGS. 7A–7B illustrate a working example of the operation of embodiments of the present invention. Referring to FIG. 6 along with FIGS. 7A and 7B, each substrate 614, 616 is respectively defined by an outer trench 712, 714 of nozzles and an inner trench 716, 718 of nozzles. Each outer trench 712, 714 of nozzles is located on a respective outer edge of each substrate that is not adjacent to the other substrate. In contrast, each inner trench 716, 718 of nozzles is located on a respective inner edge of each substrate that is adjacent to the other substrate. As shown in FIGS. 7A and 7B, a portion of each trench 712, 714, 716, 718 is in respective adjacent overlapping regions 720, 722, shown as the cross-hatched areas.

In one embodiment, as shown in FIG. 7A, the timing controller 110 formulates the synchronized firing pattern discussed above by sending firing signals to print in all trenches, both in the adjacent overlapping regions 720, 722 and the non-overlapping regions. Designated distribution of the ink can be used for each trench of nozzles. Namely, in this embodiment illustrated with two substrates, the ink ejection elements in the trenches in the non-overlapping regions are instructed by the timing controller 110 to print half of the ink drops 730 in the non-overlapping regions to create a first print zone represented by zone 740.

The ink ejection elements for each trench in the overlapping regions 720, 722 are instructed to print one quarter of the ink drops 732 in the overlapping region 720, 722 to create a second print zone represented by zone 742. With this arrangement, ink is deposited from all four trenches in the overlapping regions 720, 722 and two trenches in the non-overlapping regions. As a result, a certain delay time between ink lay down in the second print zone 742 as opposed to the first zone 740 is created.

In another embodiment, as shown in FIG. 7B, the timing controller 110 formulates the synchronized firing pattern discussed above by sending firing signals to print in some of the trenches that are in the overlapping regions 720, 722 and with all of the trenches in the non-overlapping regions. Specifically, in this embodiment illustrated with two substrates, the ink ejection elements of all trenches 712, 714, 716, 718 in the non-overlapping regions are instructed to print half of the ink drops 750 in the non-overlapping regions to create a first print zone 752.

The ink ejection elements of the inner trenches 716, 718 are instructed to print half of the ink drops 754 in the overlapping regions 720, 722 to create a second print zone 756. As such, each trench has half of the ink drops 750 printed in the first print zone 752 and the other half of the ink drops 754 in the second zone 756. In contrast to the embodiment of FIG. 7A, the embodiment of FIG. 7B creates less variation in delay time between ink lay down in the second print zone 756 as opposed to the first print zone 752 due to ink lay down from two trenches in both the overlapping and non-overlapping regions. In the embodiment of FIG. 7B, the difference in time delay between the overlapping and non-overlapping regions is significantly reduced as compared to the embodiment of FIG. 7A.

This is because the print zone 742 of FIG. 7A is greater than the print zone 752 of FIG. 7B. The first print zone 752 of FIG. 7B has a length that is slightly larger than the length of the second print zone 756. In contrast, the first print zone 740 of FIG. 7A is much smaller than the second print zone 742 of FIG. 7A. As a result, the system of FIG. 7B will produce a more consistent time delay between ink lay down in the first and second print zones. This will result in a decrease in print banding and associated artifacts and more consistent ink to print media interaction, which will improve image quality.

The foregoing has described the principles, preferred embodiments and modes of operation of the present invention. However, the invention should not be construed as being limited to the particular embodiments discussed. The above-described embodiments should be regarded as illustrative rather than restrictive, and it should be appreciated that workers may make variations in those embodiments skilled in the art without departing from the scope of the present invention as defined by the following claims.

What is claimed is:

1. A control method for an inkjet printhead having a plurality of substrates with adjacent overlapping and non-overlapping regions between the substrates, the method comprising:

synchronizing a difference in time delay between ink ejected from the adjacent overlapping and non-overlapping regions of each substrate to reduce the difference.

2. The method of claim 1, further comprising initially determining the overlapping and non-overlapping regions of adjacent substrates.

3. The method of claim 1, further comprising determining a difference in time delay between ink ejected from the adjacent overlapping and non-overlapping regions.

4. The method of claim 1, wherein synchronizing the difference in time delay between ink ejected from the adjacent overlapping and non-overlapping regions of each substrate comprises maintaining a consistent time delay difference between ink ejected from the adjacent overlapping and non-overlapping regions.

5. The method of claim 1, wherein the plural substrates form multiple single substrate printhead modules.

6. The method of claim 1, wherein the plural substrates form a single printhead module.

7. The method of claim 1, wherein the plural substrates form multiple single substrate printhead modules and a single printhead module.

8. The method of claim 1, further comprising sending firing signals to each substrate to fire ink ejection elements in a portion of the substrate in the adjacent overlapping regions and with all of the ink ejection elements in the non-overlapping regions.

9. The method of claim 1, wherein synchronizing the difference in time delay between ink ejected from the adjacent overlapping and non-overlapping regions of each substrate includes reducing a difference between a first print zone defined by the non-overlapping regions and a second print zone defined by the adjacent overlapping regions.

10. An inkjet printing system, comprising:

plural substrates located adjacent to one another with adjacent overlapping and non-overlapping regions existing between each substrate;

a plurality of heating elements disposed on each substrate;

a plurality of ink ejection chambers for ejecting ink and located adjacent to each substrate, each chamber associated with a different one of the respective heating elements; and a controller operatively connected to the heating elements, the controller receiving and processing print data to create a consistent time delay difference between ink ejected from the adjacent overlapping and non-overlapping regions of the ink ejection elements of each substrate.

11. The inkjet printing system of claim 10, wherein the plural substrates form multiple single substrate printhead modules.

12. The inkjet printing system of claim 10, wherein the plural substrates form a single printhead module.

13. The inkjet printing system of claim 10, wherein the plural substrates form multiple single substrate printhead modules and a single printhead module.

14. The inkjet printing system of claim 10, wherein the controller includes plural timing controllers that are synchronized with each other and each disposed on an associated substrate.

15. The inkjet printing system of claim 10, wherein each substrate includes inner and outer trenches containing the ink ejection and heater elements and wherein a portion of each trench is located within the adjacent overlapping regions.

16. The inkjet printing system of claim 15, wherein the ink ejection elements of all trenches in the non-overlapping regions are instructed to print 50% ink drops in the non-overlapping regions to create a first print zone and the ink ejection elements of the inner trenches are instructed to print 50% ink drops in the adjacent overlapping regions to create a second print zone.

17. The inkjet printing system of claim 16, wherein each trench has 50% of the ink drops printed in the first print zone and 50% of the ink drops in the second zone.

18. An inkjet printhead having a plurality of substrates with plural ink ejection elements, each ink ejection element having a heating element, the inkjet printhead comprising:

means for determining a location of the ink ejection and heater elements in adjacent overlapping and non-overlapping regions of adjacent substrates; and maintaining a consistent time delay difference between ink ejected from the adjacent overlapping and non-overlapping regions.

19. The inkjet printhead of claim 18, wherein the plurality substrates form multiple single substrate printhead modules.

20. The inkjet printhead of claim 18, wherein the plurality substrates form a single printhead module.

21. The inkjet printhead of claim 18, wherein the plurality substrates form multiple single substrate printhead modules and a single printhead module.

22. A method in a thermal inkjet printhead having a plurality of substrates with adjacent overlapping and non-overlapping regions between the substrates, comprising:

determining a location of ink ejection and heater elements in adjacent overlapping and non-overlapping regions of adjacent substrates; and maintaining a consistent time delay difference between ink ejected from the adjacent overlapping and non-overlapping regions.

23. The method of claim 22, wherein synchronizing the difference in time delay between ink ejected from the adjacent overlapping and non-overlapping regions of each substrate includes reducing a difference between a first print zone defined by the non-overlapping regions and a second print zone defined by the adjacent overlapping regions.

24. The method of claim 22, further comprising sending firing signals to each substrate to fire ink ejection elements in a portion of the substrate in the adjacent overlapping regions and with all of the ink ejection elements in the non-overlapping regions.

25. In a system for an inkjet printhead having a plurality of substrates with adjacent overlapping and non-overlapping regions between the substrates, a computer-readable medium having computer-executable instructions for performing a process on a computer, the process comprising:

synchronizing a difference in time delay between ink ejected from the adjacent overlapping and non-overlapping regions of each substrate to reduce the difference.

26. The computer-readable medium having computer-executable instructions for performing the process of claim 25, further comprising initially determining the adjacent overlapping and non-overlapping regions of adjacent substrates.

27. The computer-readable medium having computer-executable instructions for performing the process of claim 25, further comprising determining a difference in time delay between ink ejected from the adjacent overlapping and non-overlapping regions.

28. The computer-readable medium having computer-executable instructions for performing the process of claim 25, further comprising maintaining a consistent time delay difference between ink ejected from the adjacent overlapping and non-overlapping regions.

29. The computer-readable medium having computer-executable instructions for performing the process of claim 25, further comprising sending firing signals to each substrate to fire ink ejection elements in a portion of the substrate in the adjacent overlapping regions and with all of the ink ejection elements in the non-overlapping regions.

30. The computer-readable medium having computer-executable instructions for performing the process of claim 25, wherein synchronizing the difference in time delay between ink ejected from the adjacent overlapping and non-overlapping regions of each substrate includes reducing a difference between a first print zone defined by the non-overlapping regions and a second print zone defined by the adjacent overlapping regions.

* * * * *